United States Patent [19]

Schudel

[11] Patent Number: 4,804,972

[45] Date of Patent: Feb. 14, 1989

[54] MONOCOQUE ANTENNA STRUCTURE

[76] Inventor: Conrad R. Schudel, 2014 Saliente Way, Carlsbad, Calif. 92008

[21] Appl. No.: 17,827

[22] Filed: Feb. 24, 1987

[51] Int. Cl.[4] ..... H01Q 19/12

[52] U.S. Cl. ..... 343/840; 343/880; 343/872; 343/915; 343/882

[58] Field of Search ..... 343/840, 872, 880, 882, 343/761, 839, 915, 916

[56] References Cited

U.S. PATENT DOCUMENTS

| | | | |
|---|---|---|---|
| 3,056,131 | 9/1962 | McCreary | 343/840 |
| 3,351,947 | 11/1967 | Hart | 343/840 |
| 4,086,599 | 4/1978 | Vanderlinden | 343/882 |
| 4,656,486 | 4/1987 | Turner | 343/882 |
| 4,672,389 | 6/1987 | Ulry | 343/880 |

FOREIGN PATENT DOCUMENTS

| | | | |
|---|---|---|---|
| 3530809 | 3/1987 | Fed. Rep. of Germany | 343/882 |
| 0207702 | 11/1984 | Japan | 343/880 |

*Primary Examiner*—William L. Sikes
*Assistant Examiner*—Hoanganh Le
*Attorney, Agent, or Firm*—Wilfred G. Caldwell

[57] ABSTRACT

An enclosed terrestrial antenna system of monocoque construction for receiving television signals from satellites in geostationary orbit. The basic antenna comprises two dish-shaped members having substantially identical configurations, each of which is a surface of revolution. Each member (called a "dish" in the industry) has a central concave parabolic area surrounded by an upstanding frusto-conic rim. One, the antenna dish, has an electromagnetic radiation reflecting surface on the concave side. The other, the cover dish, is substantially transparent to electromagnetic radiation. The cover dish has an opening at the center, along the axis of revolution. The two dishes are secured together, concave face to concave face. A feed mount is secured to the cover dish over the opening and carries the feed assembly in a manner allowing the feed assembly to be moved toward and away from the reflective surface to focus the feed. Suitable ground supports are provided to hold the antenna assembly with the axis of revolution aligned at a selected azimuth and elevation. A cover is provided over the feed assembly, secured to the feed mount or vover dish. Thus, the antenna assembly is fully enclosed and protected from the weather or other outside influences.

39 Claims, 3 Drawing Sheets

MONOCOQUE ANTENNA STRUCTURE

BACKGROUND OF THE INVENTION

This invention relates in general to antennas and, more specifically, to a monocoque constructed fully enclosed terrestrial antenna for receiving signals from satellites in geostationary orbit.

The first communications satellite, Telstar I, placed in geostationary orbit, 22,300 miles over the equator in 1962 could carry only one television signal or 12 telephone calls at one time. Today, many communications satellites are in geostationary orbit, each capable of handling 24 television signals. Originally, signals were fed to the satellite by an uplink dish at a television studio and beamed back to earth to receiving antennas at television broadcast stations. In 1976 the first home-built private receiving antenna was put into use. Since then, the home satellite market has grown rapidly, with hundreds of thousands of home antenna systems now in use worldwide.

A wide variety of antennas are in use, generally having diameters of from about 6 to 20 feet and made from many materials. Each system basically consists of a concave dish having the ability to reflect incoming signals to a feedhorn assembly positioned above the center of the dish, which collects the incoming signal, passes it through a low-noise amplifier and downconverter, then to a satellite receiver and finally to a conventional television set. The axis of rotation of the antenna must be pointed at the desired satellite in order to receive a signal therefrom. Both manually adjusted ground supports and polar mounts which can be manually cranked or motor driven are available.

The antenna dish may be made from metal, which may be in the form of a mesh, or an insulating material such as glass fiber reinforced plastic, thermoformable or moldable plastic, or other materials having a conductive layer or coating that may be sandwiched in or on the concave face. The feedhorn assembly is generally supported on a rod attached near the center of the antenna and extending out to a point above the antenna surface. The concave face is ordinarily exposed to the elements.

While these antennas generally produce acceptable results, a number of problems remain. Snow, rain, leaves and other foreign matter often collects on the upwardly-pointed concave antenna surface, degrading picture quality. Rain on the surface deflects the signal, since the signal must pass through the water twice. This is a particular problem with the "KU" (12 ghz) band.

When a dish is exposed to sunlight, with part of the concave surface exposed to sunlight and part in the shade, differential thermal expansion cause distortions in the surface, degrading picture quality.

Such antennas, being flat across the opening and having a convex underside, may produce an airfoil effect in some wind conditions, causing dish movement, vibration and possible destruction. Also, winds impinging directly on the feedhorn assembly at the end of a thin mounting rod may cause vibration adversely affecting picture quality. The thin unsupported dish surface may need to be heavy or have a number of supporting ribs to provide sufficient strength. Such antennas appear "busy" and unattractive.

Thus, there is a continuing need for satellite signal receiving antennas which overcome the above-noted problems and provide other advantages and features.

SUMMARY OF THE INVENTION

The problems discussed above, and others, are overcome by the antenna of this invention which may basically comprise a pair of dish-shaped members which have substantially identical shapes, one an antenna dish which reflects electromagnetic radiation and the other a cover dish which is transparent to electromagnetic radiation. Of course, the two dishes need not be identical. For example, the antenna dish may be curved and the cover dish conical or flat. Each dish is a surface of rotation having a center region surrounded by an upstanding frusto-conical rim. The two dishes are secured together in a concave face to concave face arrangement providing a unitary monocoque structure. The cover dish has an opening at the axis of rotation. A feed mount means is secured to the edges of the opening and has an axial means for supporting a signal feed means in a manner permitting the feed to be moved toward and away from the antenna dish to focus the feed. A ground support means is provided to support the antenna with the axis aligned at the desired elevation and azimuth. A cover is provided over the feed means.

When assembled, this antenna system is fully enclosed and protected from the elements with a protected vent arrangement to equalize air pressure in and outside the antenna assembly. A drain at the low point releases any condensed moisture and serves as an additional air vent. The cover dish provides uniform shade over the antenna dish to prevent thermal gradients distorting the antenna dish contour. The interior may be easily heated in winter if needed. The cover may be formed from optically transparent or translucent material and have no opening at the axis of rotation, with advertising or other information thereon. The interior may be illuminated to make the advertising stand out at night. The antenna is smooth, attractive and aero dynamically streamlined. Assembled the monocoque construction allows the dishes to be light in weight and shape retaining. When unassembled, the parts are easily shipped in a nested arrangement, either in formed halves or in sections.

BRIEF DESCRIPTION OF THE DRAWING

Details of the invention, and of a preferred embodiment thereof, will be further understood upon reference to the drawing, wherein.

DETAILED DESCRIPTION OF THE INVENTION

Figure 1:
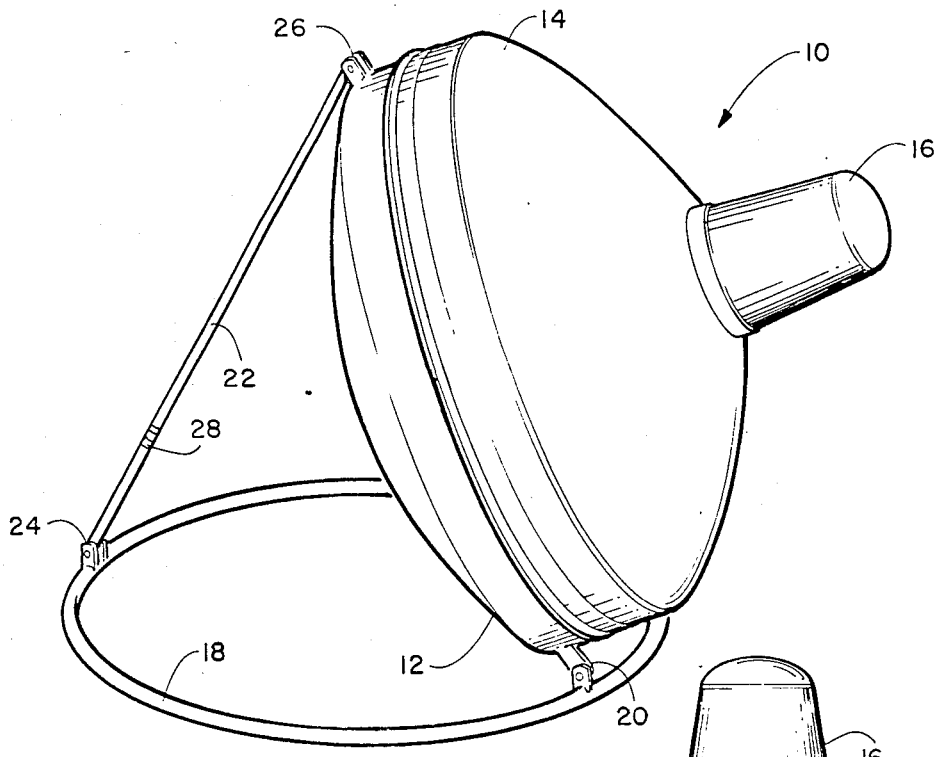
FIG. 1 is a perspective view of the antenna system of my invention with a preferred manual ground mount.

Referring now to FIG. 1, there is seen the antenna system 10 of my invention supported by a manually adjustable ground mount arrangement. The external components of antenna system 10 include an antenna dish 12, a cover dish 14 and a feed assembly cover 16. Details of these external components and all internal components are provided below. In the embodiment of FIG. 1, the antenna system is mounted on a ground-engaging ring 18 by means of hinges 20 (one of which is hidden) and a telescoping rod 22 which is hinged to ring 18 at 24 and to antenna dish 12 at 26. Rod 22 includes an upper portion which slides into the lower portion and is locked in a desired position by a conventional lock ring 28. If desired, ground engaging ring 18 could be T-shaped. Also ring 18 could be hollow and filled with sand, water or the like to further stabilize the antenna.

The assembly is positioned in azimuth by rotating the entire assembly on the ground and in elevation by varying the extension of rod 22. Proper alignment can be ascertained using a signal strength meter or merely observing picture quality on a television set connected to the system through conventional electronic components. This mount is inexpensive, light weight, easily moved to different locations and simple and attractive in appearance. This type of mount is best where the antenna is left in alignment with a single satellite for extended periods. As discussed below, a manually or automatically adjusted polar mount may be preferred if frequent changes among several satellites is desired.

Figure 2B:
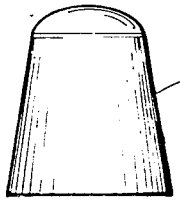
FIG. 2B is a detail perspective view of my antenna in an alternative embodiment having a transparent cover.
Figure 2B:
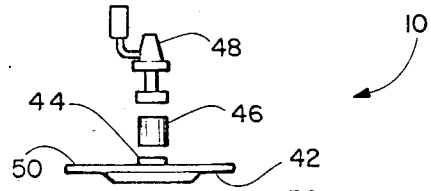
Figure 2B:
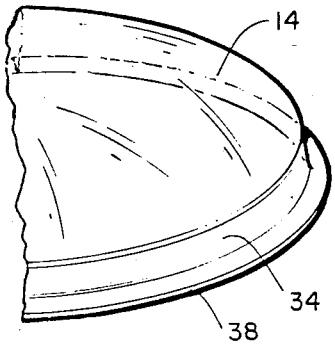
Figure 2A:
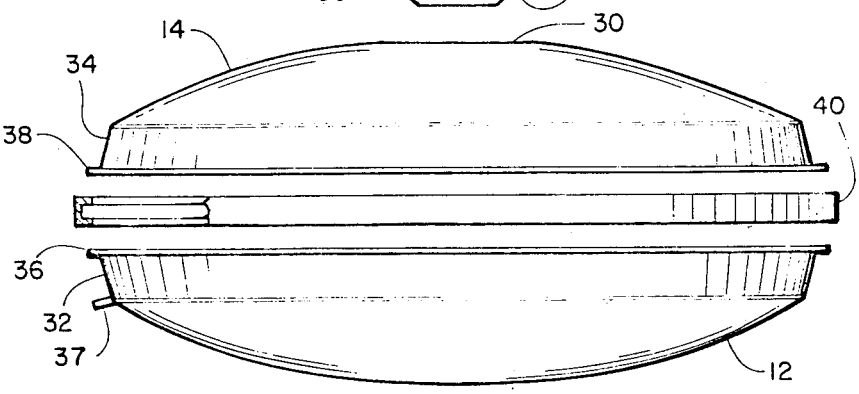
FIG. 2A is an exploded elevation view of my antenna system.

Details of the antenna system assembly are provided in exploded form in FIG. 2A. Antenna dish 12 and cover dish 14 may be substantially identical in configuration, the only necessary differences being that antenna dish 12 must have a signal reflecting surface, cover dish 14 must be transparent to electromagnetic radiation signals and cover dish 14 has opening 30. The area normally occupied with an opening 30 may include a reflective surface for secondary radiation well known in this art. The feed horn may be relocated to collect this radiation or energy. Additional feed horn or horns may be used at different focal points for radiation or energy collection.

Antenna dish 12 may be made of any suitable material, such as spun metal such as aluminum, various structural plastics or fiber reinforced plastics, etc. The preferred material of construction is impact resistant plastics which allow yielding upon impact and have sufficient memory to return undamaged to their original configuration. The use of this type plastic also permits precise shape forming to be accomplished with low cost tooling and industry standard thermo forming equipment. A conductive layer is provided on the inner surface, such as by painting with a suitable conductive paint, bonding a thin aluminum foil thereto, or the like. Since the inner surface is protected from the weather and sunlight, many conductive paints or lamina which could not be used in an exposed antenna can be used here. Cover dish 14 may be formed from the same material as the antenna dish 12 or any material which is transparent to the satellite signal, such as structure plastics, fiber reinforced plastics, etc.

Each of dishes 12 and 14 has a central parabolic curved area, a frusto-conical rim 32 and 34, respectively, and preferably and outwardly-extending flange 36 and 38, respectively. While the shape of cover dish 14 need not match that of antenna dish 12, for ease of manufacturing, shipping and uniform appearance the substantially identical shape is preferred. Any suitable curve depth for the central sections may be used.

Rims 32 and 34 in addition to providing structural rigidity and improved appearance over the "clamshell" effect produced by simply bringing two curved sections together also greatly improve rejection of terrestrial interference when the inner surfaces of either or both rims are coated with a signal reflecting material.

In general, an f/D ratio (f ocal length of the feed divided by the D iameter of the curved section) of about 0.4 produces the cleaner pattern and has some rejection of terrestrial interference, while a ratio of about 0.6 provides the maximum gain. Most commercial antennas have f/D ratios from about 0.35 to 0.40, with the first giving the best resistance to interference and the second being a compromise between rejection of terrestrial interference and gain. Because of the excellent terrestrial interference rejection of my antenna with reflective or absorbent rim areas a higher f/D number can be used, giving improved gain while retaining high picture quality.

If desired, flanges 36 and 38 can be simple bonded together with any conventional adhesive or chemical suitable for the dish materials. To assure accurate alignment, it is preferred that a rigid steel ring alignment fixture (not shown) be placed over each dish, engaging the outer flange surface and the outer rim surface of each dish to insure precise dish to dish alignment as they are brought together for bonding. Also accurately placed reference marks on each dish made during forming thereof or by a fixture provide accurate alignment prior to bonding. Any other desired fastening method other than adhesive or chemical may be used, if desired, such as a plurality of small spaced bolts, rivets, screws, staples or clamps. While flanges 36 and 38 are preferred for ease of assembly, they could be omitted and the dish rims could be directly fastened together by overlapping. For added strength and appearance, a ring 40 (shown partially cutaway in FIG. 2A) having an inwardly directed "U" shape may be placed over the secured flanges 36 and 38. The ring 40 may be a preformed ring with a single break which is snapped over the flanges or may be a plurality of short segments. The ring 40 may be secured with an adhesive as well as any other convenient fastening means.

FIG. 2B shows an alternative embodiment having an optically transparent cover dish 14 for use with laser rather than microwave signals. Any material transparent to the laser wavelength may be used. Typically, a transparent plastic such as methyl methacrylate may be used.

Figure 4:
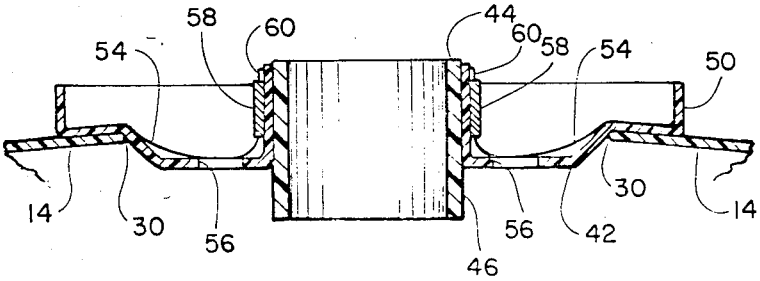
FIG. 4 is a section view of the feedhorn support means, taken on line 4—4 in FIG. 3.

A feed mount 42 fits within opening 30 and is secured to cover dish 14. Feed mount 42 is detailed in FIGS. 3 and 4. An axial tubular opening 44 slideably receives a short tube 46 within which the end of a conventional feedhorn assembly 48 is fastened. Tube 46 is moved toward and away from the inner surface of antenna dish 12 until an optimum combination of gain and picture quality is obtained, then tube 46 is fastened to feed mount 42. Feed horn 48 and feed mount 42 are covered with a feed cover 16 to protect them from the elements and provide a smooth, pleasing appearance. While feed cover 16 may be fastened to cover dish 14 directly, I prefer to fasten it to an upstanding flange 50 on feed mount 42 for rigidity and easy access to the feedhorn 48. Prior antennas mount the feed assembly on one or more rods extending out from the antenna dish surface or outer rim. The rods are not easily secured to the surface and the feed and may be bent, off center or axis or vibrate in heavy winds and they are an obstruction in the energy path. My feed mount and cover overcome those problems.

Figure 3:
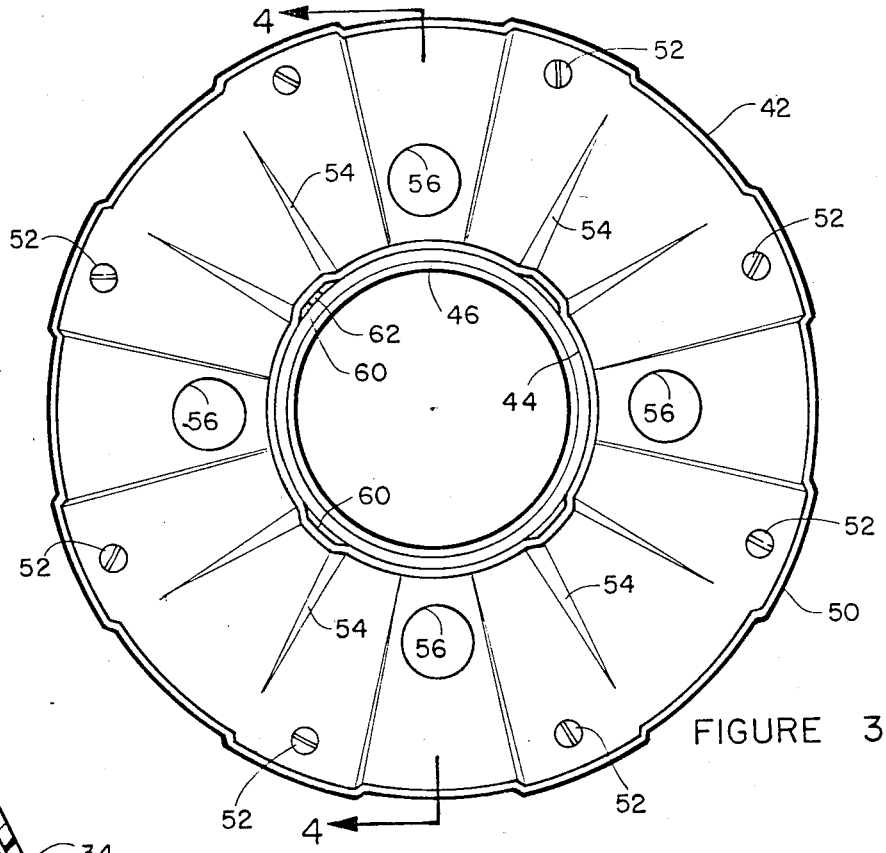
FIG. 3 is a plan view of the feedhorn support means.

A plurality of bolts or screws 52 secure mount 42 to cover dish 14. The mount may be attached by other means, such as bonding. Any suitable gasket or caulking material may be used between the abutting surfaces to prevent water leaking into the assembly. A plurality of ribs 54 help stiffen the body of the mount structure between flange 50 and center tubular opening 44. Alternatively, the body of mount 42 could be thicker and extend straight between flange 50 and tubular opening 44, although the configuration shown is preferred to lowest weight consistent with sufficient strength. Several holes 56 are provided to vent the interior of the antenna assembly to the feed cover interior. Upstanding flange 50 is corrugated as seen in FIG. 3 so that when feed cover 16 is slipped thereover a better fit results for fastening to the outwardly extending corrugations with screws or the like, air can pass between the inward corrugations and the feed cover, then through holes to prevent pressure buildup in the assembly as outside temperature varies. Moisture may condense within the housing due to the cooling of warm moist air trapped within the antenna to a temperature below its dew point as the antenna cools. A small drain opening or tube 37 (as seen in FIG. 2A) may be provided at the lower most point on antenna dish 12 to release condensation. Flange 50 prevents the entry of water through the openings 56 (FIG. 3).

Tubular opening 44 at the center of mount 42 lies on the axis of rotation of the antenna assembly. A short tube 46 slideably fits within opening 44. A cylindrical lower end on feed horn 48 (as seen in FIG. 2) fits within tube 46 and is fastened thereto by screws, adhesive, or the like. When the antenna is being set up, the feedhorn assembly 48 and the tube 46 are moved upwardly and downwardly to obtain the best television picture, then the tube 46 is secured in place by clamp 58 which surrounds tube 46 and tubular opening 44 and operates in the manner of a conventional automotive hose clamp. One or more recesses 60 around the periphery of opening 44 serve as keyways to receive a key 62 on tube 46 to assure proper alignment when the tube and feed horn are removed and replaced.

Figure 5:
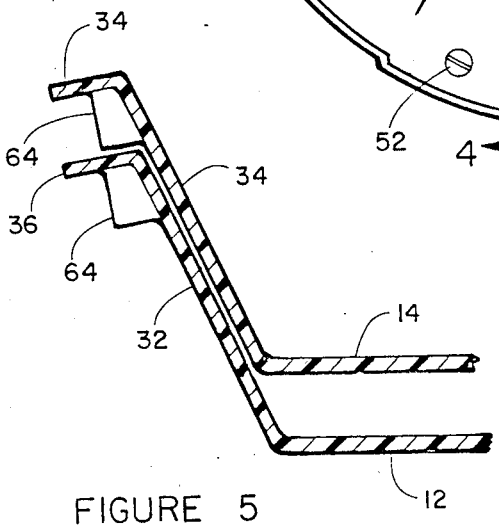
FIG. 5 is a detail section view of the edges of my dishes in a nested shipping arrangement.

Since antenna dish 12 and cover dish 14 are identical in configuration, they can be easily nested for shipment. In fact, a number of antenna sets could be stacked in the manner shown in FIG. 5. However, it is possible for the stack to be pressed together so tightly as to wedge together, making separation difficult and damage likely. In order to prevent this, I prefer to include a plurality of small bosses 64 spaced along each dish in the corner between rim 32 or 34 and flange 36 or 38, respectively.

Figure 6:
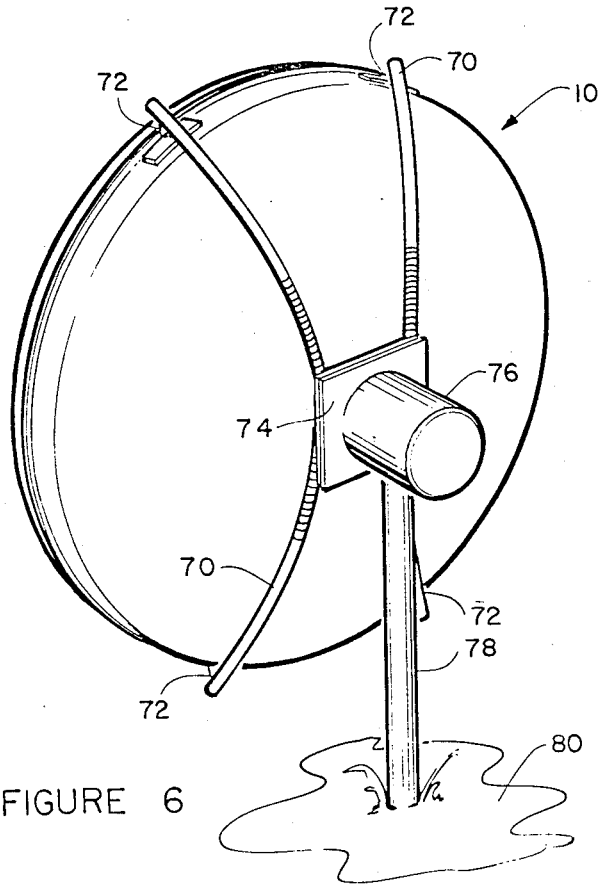
FIG. 6 is a perspective view of my antenna system with an alternative, polar, mount.

An alternative embodiment of the antenna terrestrial mounting means shown in FIG. 1 is illustrated in FIG. 6. Two curved metal tubes or rods 70 have ends secured to reinforced areas 72 on an antenna dish 12. Tubes 70 do not contact the curved surface of dish 12, preventing any distortion which would be likely if the mount was secured to a reinforced area at the center of curved portion of dish 12. A plate 74 is fastened to tubes 70, such as by welding or bolts. A polar drive unit is schematically indicated at 76 which is capable of moving the antenna assembly 10 in both azimuth and elevation, either by manual means such as hand cranks or by electrical motor drive, which could be remotely controlled. Such mechanisms are well known both for moving antennas and telescopes and are available from a great number of vendors. Polar drive unit 76 is typically mounted on a post 78 which may be embedded in the earth 80 or in concrete.

Figure 7:
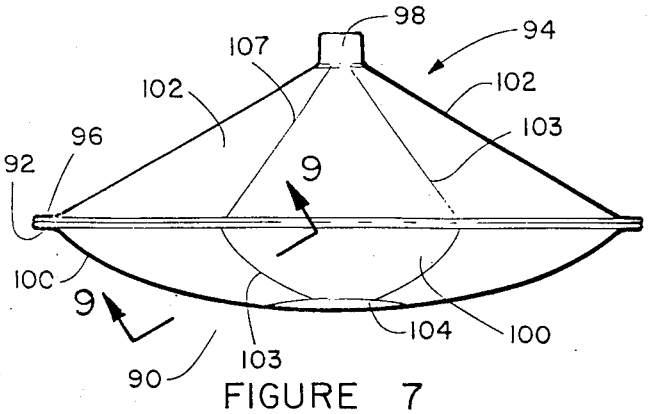
FIG. 7 is a schematic elevation view of an alternative embodiment of the antenna dish assembly.

An alternative configuration for the antenna dish assembly is shown in side elevation in FIG. 7. Here, the antenna dish 90 has a parabolic curvature similar to the antenna dishes discussed above. An outwardly extending flange 92 extends around the rim of dish 90. This cover dish 94 in this case has a conical shape with an outwardly extending flange 96 extending around the base and feed mount 98 at the apex. In this embodiment, both dishes 90 and 94 are assembled from a plurality of pie-shaped segments 100 and 102, respectively. Antenna dish 90 also has an approximately round or polygonal center segment 104. Each of these segments has a fastening means, such as an upstanding flange 103, along each side that meets an adjacent segment. The segments may be fastened together using any suitable fastening, such as an adhesive inter layer, a solvent bond between suitable plastic flanges, a melt bond achieved through ultra-sonic heating of abutting flanges, bolts, screws, staples, or the like.

Figure 8:
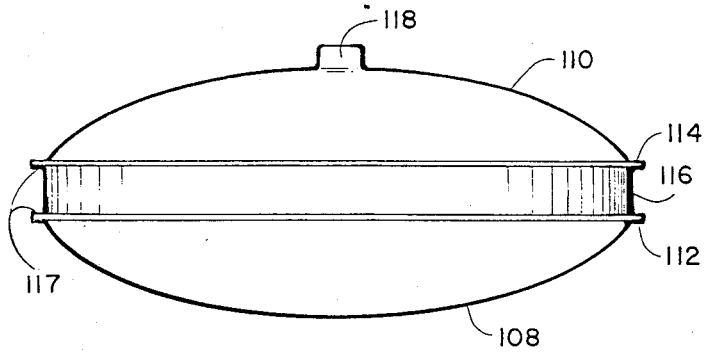
FIG. 8 is a schematic elevation view of another alternative embodiment of the antenna dish assembly.

FIG. 8 shows another embodiment of the dish assembly in schematic side elevation. Here, each of antenna dish 108 and cover dish 110 has a parabolic curved shape with an outwardly extending flange 112 and 114, respectively, along the outer edges. A rim member 116 (functioning like rims 32 and 34 as discussed above) has a cylindrical shape and has a pair of outwardly extending flanges 117 positioned to contact flanges 12 and 14 and to be secured to them by any suitable method, such as those mentioned in the paragraph above. Cover dish 110 is provided with a central feed mount 118. Of course, the dish assembly shown in FIG. 8 could have a cover dish having some other shape, such as the conical shape shown in FIG. 7 and one or both dishes and/or rim member 116 could be made up of segments if desired.

Figure 9:
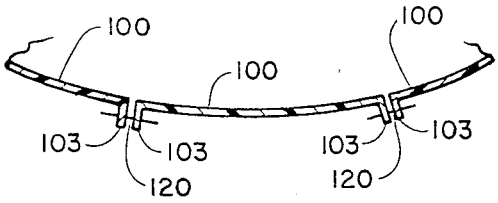
FIG. 9 is a schematic section view through a segment fastening means taken substantially on line 9—9 in FIG. 7.

FIG. 9 illustrates in schematic section the interconnection between segments 100 in FIG. 7. Upstanding flanges 103 abut and are secured together by bolts 120 or any of the other securing or bonding means mentioned above. In FIG. 9 flanges 103 are spaced slightly for clarity.

Figure 10:
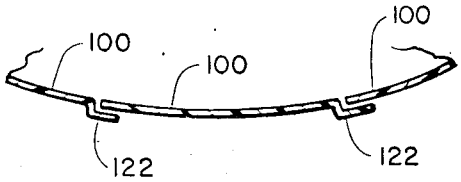
FIG. 10 is a schematic section view through a second embodiment of a segment fastening means taken on substantially the same line as is FIG. 9.

FIG. 10 shows in schematic section an alternative means securing adjacent dish segment 100 and 100 together. Here, one edge of each segment 100 has an offset flange 122 parallel to the segment surface. The offset flange overlaps the adjacent edge and is bonded or fastened thereto by any of the methods discussed above. Other fastening techniques may be used if desired. For example, simple straight segment edges can be brought together and an overlapping narrow strip can be bonded or fastened thereover. The strip could be the base of a "T" or channel section to add further reinforcement and strength.

Figure 11:
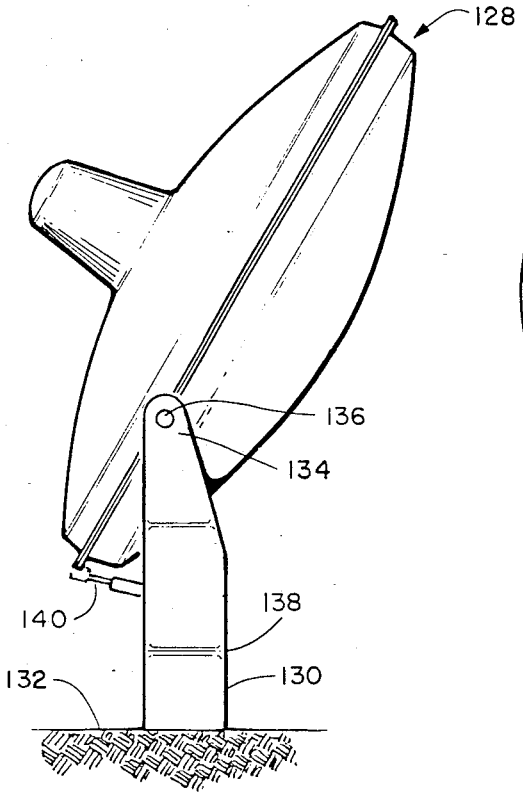
FIG. 11 is a schematic side elevation view illustrating an alternative ground mount of antenna such as that shown in FIG. 1.
Figure 12:
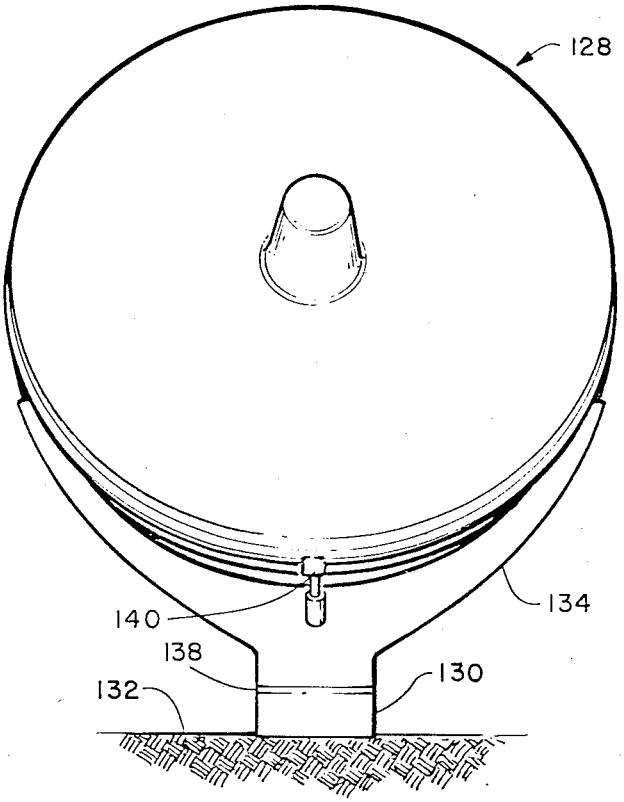
FIG. 12 is a schematic front elevation view of the embodiment of FIG. 11.

FIGS. 11 and 12 illustrate another suitable embodiment of a ground mount for my antenna. Here, any of my dish assemblies 128, such as that shown in FIG. 1, can be mounted on a sturdy post 130 which is embedded in or fastened to the ground or a baseplate 132. A generally Y-shaped upper bracket 134 is fastened to dish assembly 128, typically by pivoting means 136 at the bracket ends engaging reinforce dish areas in a conventional manner. A conventional linear actuator 140 may be used to pivot dish assembly 128 about pivot 136. Pivot means 138 for rotating bracket 134 relative to the base of post 130 may be provided to allow easy manual or automatic alignment of the dish axis.

Pivot means may be any conventional means allowing arms 134 and upper post 130 to be rotated relative to lower post 130, such as a simple axial pin extending along the post centerline between the two ends of post 130 which meet at pivot 138 or any of the well known thrust bearing arrangements.

While certain specific materials, configurations and dimensions were described in the above description of preferred embodiments, these can be varied, where suitable, with similar results. For example the antenna dishes can be made of almost any material which can be formed or molded and which has the desired electrical characteristics. The conductive or reflective layer on the antenna dish may be coated on the concave surface, or imbedded in, sandwiched within or laminated to the surface. The conductive material may be paint, aluminum foil, metal screen matts or mesh, metalized fabric or film, etc.

As can be discerned, a unique satellite television an/or microwave antenna of monocoque construction has been disclosed.

Other variations, applications and ramifications of this invention will occur to those skilled in the art upon reading this disclosure. Those are intended to be included within the scope of this invention as defined in the appended claims.

What is claimed is:

1. A monocoque antenna dish and cover each having substantially the same overall configuration which is a surface of revolution;

said dishes each having a concave center region surrounded by an outwardly extending frusto-conical rim;

at least the curved surface of said antenna dish being capable of reflecting electromagnetic radiation;

the curved surface of said cover dish being substantially transparent to selelcted radiation;

means for securing said two dishes together in a concave face to face relationship to form a symmetrical antenna assembly;

said cover dish having an opening at substantially the center thereof;

feed mount means mounted on said cover dish over said opening;

at least one feedhorn assembly mounted on said feed mount means; along an axis relative to the curved surface of said antenna dish at a location to receive maximum reflected radiation; and means for moveably supporting the antenna assembly with said axis at an angle to the surface of the earth.

2. The antenna assembly according to claim 1 wherein said means for moveably supporting the antenna assembly comprises:

an earth-engaging ring hingedly connected to the rim of said antenna dish at two spaced locations;

a telescoping tube member having a first end hingedly connected to said ring at a location opposite to said rim connections;

a second end hingedly connected to said antenna dish rim at a location opposite said ring-to-rim connections; and locking means for locking said telescoping tube at a selected extension.

3. The antenna assembly according to claim 1 wherein said means for moveably supporting the antenna assembly comprises:

two elongated rods connected at adjacent locations to said antenna dish rim and extending across the back of said assembly;

a mounting plate secured to said rods at substantially the center of said antenna dish;

a polar drive means fastened to said plate; and a support column in a substantially vertical position;

whereby said means for moveably supporting said antenna assembly is capable of moving said antenna in azimuth and elevation.

4. The antenna assembly according to claim 1 wherein said means for moveably supporting the antenna assembly comprises:

a generally Y-shaped bracket having ends pivotably secured to opposite sides of said antenna dish whereby said dish can be pivoted about a substantially horizontal axis; and the base of said bracket being pivotably secured to a substantially vertical post whereby said bracket and antenna dish may be rotated about a substantially vertical axis.

5. The antenna assembly according to claim 4 further including a linear actuator means between said antenna dish and said bracket to pivot said antenna assembly about said horizontal axis.

6. The antenna assembly according to claim 1 wherein said cover dish is transparent to microwave radiation, optical radiation or both.

7. The antenna assembly according to claim 1 wherein said at least one feed mount comprises:

a generally circular body adapted to cover and overlap said central opening in said cover dish;

means to fasten said body to said cover dish;

said feed mount having a tubular opening aligned with the axis of rotation of said antenna;

said tubular opening adapted to slideably receive a tube carrying said feedhorn assembly;

fastening means for securing said tube within said tubular opening at a selected position.

8. The antenna assembly according to claim 7 wherein said at least one feed mount further comprises:

at least one vent opening through said body;

an at least partially corrugated upstanding flange around said body having inwardly and outwardly extending corrugations;

whereby the inwardly extending corrugations insure proper fitting between the upstanding flange and feed cover.

9. The antenna assembly according to claim 1 further including narrow flanges extending outwardly from the rim edges of each dish, said flanges lying in a plane substantially perpendicular to the axis of revolution of the dishes.

10. The antenna assembly according to claim 9 further including a plurality of small bosses spaced along each dish in the corner between said rims and corresponding flanges whereby said dishes can be shipped in nested assemblies with each dish resting on the bosses without direct dish surface contact between adjacently stacked dishes.

11. The antenna assembly according to claim 9 further including an adhesive layer between said flanges adapted to bond said dishes together.

12. The antenna assembly according to claim 11 further including a cover ring having a inwardly directed "U" shaped configuration sized to fit over and cover the outwardly extending flanges when said flanges abut.

13. The antenna assembly according to claim 1 wherein said antenna dish rim and said cover dish rim both include means making them reflectors for electromagnetic radiation, whereby interference from terrestrial sources through said rims is substantially reduced.

14. The antenna assembly according to claim 1 wherein said antenna dish rim and said cover dish rim both include means making them absorbers of electromagnetic radiation, whereby interference from terrestrial sources through said rims is subantialy reduced.

15. The antenna assembly according to claim 1 wherein said antenna dish has a parabolic curved central region and said cover dish has a conical central region.

16. The antenna assembly according to claim 1 wherein at least one of said dishes is built up from a plurality of segments.

17. The antenna assembly according to claim 1 having a substantially cylindrical rim member adapted to be secured to the edges of said concave center regions.

18. The antenna assembly according to claim 1 further including a drain means located at the low point of the assembly when in operating position, said drain adapted to release condensed moisture from within the assembly.

19. The antenna assembly according to claim 1 wherein said dishes are formed from a thermoplastic material and said dishes are secured together by ultrasonic welding of abutting surfaces.

20. The antenna assembly according to claim 1 wherein said dishes are formed from a thermoplastic material and said dishes are secured together by chemical bonding of abutting surfaces.

21. The antenna assembly according to claim 1 wherein said dishes are formed from thermoplastic material and said dishes are secured together by mechanical means.

22. A monocoque terrestrial antenna assembly for receiving signals for satellites in geostationary orbit which comprises:

an antenna dish and cover each having substantially the same overall configuration which is a surface of revolution;

said dishes having a concave center region surrounded by an outwardly extending frusto-conic rim;

flanges extending outwardly from the rim edges of each dish, at least the concave surface and rim of said antenna dish and the rim of said cover dish being capable of reflecting electromagnetic radiation;

the concave surface of said cover dish being substantially transparent to selected radiation;

means for securing said two dishes together in a concave face to concave face relationship;

said cover dish having a guiding means at substantially thecenter thereof;

feed mount means comprising a generally circular body adapted to cover and overlap said guiding means of said cover dish;

means to fasten said body to said cover dish;

said feed mount having an opening aligned with the axis of rotation of said antenna;

a feedhorn assembly;

said guiding means adapted to receive a member carrying said feedhorn assembly;

fastening means for securing said member within said opening at a selected position;

said feedhorn assembly mounted on said member and slideable therewith to permit focusing movement along said axis relative to the curved surface of said antenna dish; and means for moveably supporting the antenna assembly with said axis at an angle to the surface of the earth.

23. The antenna assembly according to claim 22 wherein said means for moveably supporting the antenna assembly comprises:

an earth-engaging ring hingedly connected to the rim of said antenna dish at two spaced locations;

a linear extendable member having a first end hingedly connected to said ring at a location opposite to said rim connections;

a second end hingedly connected to said antenna dish rim at a location opposite said ring-to-rim connections; and locking means for locking said linear extendable member at a selected extension.

24. The antenna assembly according to claim 22 wherein said means for moveably supporting the antenna assembly comprises:

two elongated rods connected at adjacent locations to said antenna dish rim and extending across the back of said assembly;

a mounting plate secured to said rods at substantially the center of said antenna dish;

a polar drive means fastened to said plate; and a support column attached to said drive means and adapted to hold said column in a substantially vertical position; whereby said means for moveably supporting the antenna assembly is capable of moving said antenna in azimuith and elevation.

25. The antenna assembly according to claim 22 wherein said means for moveably supporting the antenna assembly comprises:

a generally Y-shaped bracket having ends pivotably secured to opposite sides of said antenna dish whereby said dish can be pivoted about a substantially horizontal axis; and the base of said bracket being pivotably secured to a substantially vertical post whereby said bracket and antenna dish may be rotated about a substantially vertical axis.

26. The antenna assembly according to claim 25 further including a linear actuator means between said antenna dish and said bracket to pivot said antenna assembly about said horizontal axis.

27. The antenna assembly according to claim 25 wherein said cover is transparent to microwave radiation, optical radiation or both.

28. The antenna assembly according to claim 25 further including a plurality of small bosses spaced along each dish in the corner between said rims and corresponding flanges whereby said dishes can be shipped in nested assemblies with each dish resting in the bosses without direct surface contact between adjacent dish surfaces.

29. The antenna assembly according to claim 25 further including an adhesive layer between said flanges adapted to bond said dishes together.

30. The antenna assembly according to claim 29 further including a cover ring having a inwardly directed "U" shaped configuration sized to fit over and cover the outwardly extending flanges when bonded together.

31. The antenna assembly according to claim 25 wherein said antenna dish has a parabolic curved central region and said cover dish has a conical central region.

32. The antenna assembly according to claim 25 wherein said antenna dish has a parabolic curved central region and said cover dish is flat.

33. The antenna assembly according to claim 25 wherein at least one of said dishes is built up from a plurality of segments.

34. The antenna assembly according to claim 25 having a substantially cylindrical rim member in place of said frusto-conical rims, said rim member adapted to be secured to the edges of said concave center regions.

35. The antenna assembly according to claim 25 further including a drain means located at the low point of the assembly when in operating position, said drain adapted to release condensed moisture from within the assembly.

36. The antenna assembly according to claim 25 wherein said dishes are formed from a thermoplastic material and said dishes secured together by ultrasonic welding of abutting surfaces thereby forming a monocoque structure.

37. The antenna assembly according to claim 25 wherein said dishes are formed from a thermoplastic material and said dishes are secured together by chemical bonding thereby forming a monocoque structure.

38. The antenna assembly according to claim 25 wherein said dishes are formed from a thermoplastic material and said dishes are secured together by mechanical means.

39. The process of making a monocoque antenna for receiving microwave signals employing the steps of:

forming impact resistant plastic in thermo forming means into smooth parabolic surfaces of revolution comprising an antenna dish and a correspondingly shaped cover dish, each dish having a frusto conical rim with a peripherial flange;

forming a central opening in the cover dish;

providing indexing locations relative to each flange;

fitting the flanges together with the indexing locations mated to preserve the thermoformed parabolic surfaces of revolution;

securing the so-indexed flanges together to form a rigid antenna structure;

supporting feedhorn means by the cover dish along the axis of revolution of the cover dish;

the interior surface of the antenna dish including said rims being reflective to said signals and the cover dish being transparent to said signals; and, locating the feedhorn means along said axis within said cover dish via said opening to receive maximum reflected signals as a result of the preserved shapes of the dishes and the precise dish to dish alignment.

* * * * *